US008910712B2

(12) United States Patent
Balczewski

(10) Patent No.: US 8,910,712 B2
(45) Date of Patent: Dec. 16, 2014

(54) SYSTEM AND METHOD FOR CONVERTING CLASS II HYDRATE RESERVOIRS

(75) Inventor: John T. Balczewski, Danville, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 466 days.

(21) Appl. No.: 13/285,936

(22) Filed: Oct. 31, 2011

(65) Prior Publication Data

US 2013/0105153 A1 May 2, 2013

(51) Int. Cl.
*E21B 33/138* (2006.01)
*E21B 43/24* (2006.01)

(52) U.S. Cl.
CPC ..... *E21B 33/138* (2013.01); *E21B 43/24* (2013.01)
USPC ..... 166/285; 166/295

(58) Field of Classification Search
USPC ..... 166/263, 285, 294, 295, 302
See application file for complete search history.

(56) References Cited

U.S. PATENT DOCUMENTS

| | | | | |
|---|---|---|---|---|
| 5,002,127 | A * | 3/1991 | Dalrymple et al. | 166/295 |
| 7,537,058 | B2 * | 5/2009 | Gullapalli et al. | 166/369 |
| 2009/0032248 | A1 * | 2/2009 | Svoboda et al. | 166/249 |
| 2009/0065210 | A1 * | 3/2009 | Gullapalli et al. | 166/302 |
| 2011/0088898 | A1 * | 4/2011 | Horton et al. | 166/268 |

* cited by examiner

*Primary Examiner* — William P Neuder
(74) *Attorney, Agent, or Firm* — Melissa M. Hayworth; Marie L. Clapp; Carlos L. Hanze

(57) ABSTRACT

Clathrate reservoirs of Class II are modified in order to improve the ability to produce hydrocarbons from them. Specifically a method for improving producibility of subsurface clathrate formation underlain by a mobile aquifer includes drilling a borehole to a depth providing access to the mobile aquifer and injecting a material into the mobile aquifer such that the material passes through pore spaces and forms a barrier underlying the clathrate formation and substantially impeding fluid flow from the mobile aquifer into contact with the clathrate formation.

11 Claims, 5 Drawing Sheets

SYSTEM AND METHOD FOR CONVERTING CLASS II HYDRATE RESERVOIRS

BACKGROUND

1. Field

The present invention relates generally to exploitation of clathrate reservoirs and more particularly to improving recoverability of clathrate reservoirs.

2. Background

Clathrates are substances in which one or more molecules of one or more compounds or elements (the guest(s)) fills one or more cavities within the crystal lattice of another compound (the host). Clathrates in which the crystal lattice is formed from water molecules are commonly called hydrates. Aspects of the present invention generally relate to all types of clathrates where the guest molecule(s) are one or more types of gasses, henceforth called gas clathrates. For the purposes of the present invention the term "clathrate(s)" should be understood to refer to all types of gas clathrates. In the field of hydrocarbon exploration and development, clathrates of interest are generally clathrates in which the guests are one or more hydrocarbon gasses and the hosts are water molecules. These are also sometimes called natural gas hydrates. They can be found in low temperature and/or high pressure environments, including, for example, deepwater and permafrost areas.

Clathrate reservoirs are classified according to a three class system. Class I reservoirs are clathrates underlain by and in fluid communication with a free gas reservoir. Class II reservoirs are clathrates underlain by and in fluid communication with a mobile aquifer reservoir. Class III reservoirs are clathrates underlain by a relatively impermeable layer. Class I reservoirs are in general considered to be relatively easy to produce hydrocarbons from, for example by drilling one or more production wells through the clathrate reservoir and into the free gas reservoir. By this method, the free gas reservoir reduces in pressure as it is produced, and this pressure drop eventually causes a pressure drop in the overlying clathrate reservoir to the extent that the clathrate reservoir is no longer in the phase stability envelope for the particular type of clathrate and dissociation (separation of the clathrate into water and gas(ses) commences. The released gas in effect recharges the underlying free gas reservoir, prolonging production from that reservoir. Unfortunately, Class I reservoirs are relatively rare. In general, Class II reservoirs are considered to be much more difficult to produce hydrocarbons from because the mobile aquifer acts to keep pressure in the overlying clathrate reservoir relatively high and interfere with or prevent dissociation. Class II reservoirs are relatively common. Class III reservoirs, like Class I reservoirs are in general considered to be relatively easy to exploit (for example, see U.S. Pat. No. 7,537,058 describing production from Class III reservoirs). The inventor has determined that it may be useful to convert Class II reservoirs into Class III reservoirs to improve the ability to produce hydrocarbons therefrom.

SUMMARY

An aspect of an embodiment of the present invention includes a method for improving producibility of subsurface clathrate formation underlain by a mobile aquifer including drilling a borehole to a depth providing access to the mobile aquifer and injecting a material into the mobile aquifer such that the material passes through pore spaces and forms a barrier underlying the clathrate formation and substantially impeding fluid flow from the mobile aquifer into contact with the clathrate formation.

The method may include inducing dissociation in at least a portion of the clathrate formation to produce a fluidic material and producing the fluidic material via the borehole or via additional wells drilled into the clathrate formation.

An aspect of an embodiment of the invention may include injecting or placing cement, cement slurries, epoxies, i.e., materials that are initially liquids which physical state facilitates a) placement or injection at or near the interface between the overlying clathrate reservoir and the underlying mobile aquifer reservoir, and b) radial spreading of such materials to cover a wide area. These materials will eventually change physical states from liquids to solids and thus becoming relatively impermeable barriers between the overlying clathrate reservoir and underlying mobile aquifer reservoir.

Another aspect of an embodiment of the present invention may include a system for injecting or placing one or more guest molecules for example but not limited to ethane, propane, iso-Butane, carbon dioxide, nitrogen, i.e., guest molecules that will come into contact with the underlying mobile aquifer reservoir and form clathrates of a type that can exist at higher temperatures and/or lower pressures than the overlying clathrate reservoir, again facilitating a) placement or injection at or near the interface between the overlying clathrate reservoir and the underlying mobile aquifer reservoir, and b) radial spreading of such materials to cover a wide area. These materials will eventually change from mixtures of water and gas into clathrates thus becoming relatively impermeable barriers between the overlying clathrate reservoir and underlying mobile aquifer reservoir.

An aspect of an embodiment may include a system for performing any of the foregoing methods Aspects of embodiments of the present invention include computer readable media encoded with computer executable instructions for performing any of the foregoing methods and/or for controlling any of the foregoing systems.

DESCRIPTION OF THE DRAWINGS

Other features described herein will be more readily apparent to those skilled in the art when reading the following detailed description in connection with the accompanying drawings, wherein.

DETAILED DESCRIPTION

Figure 1:
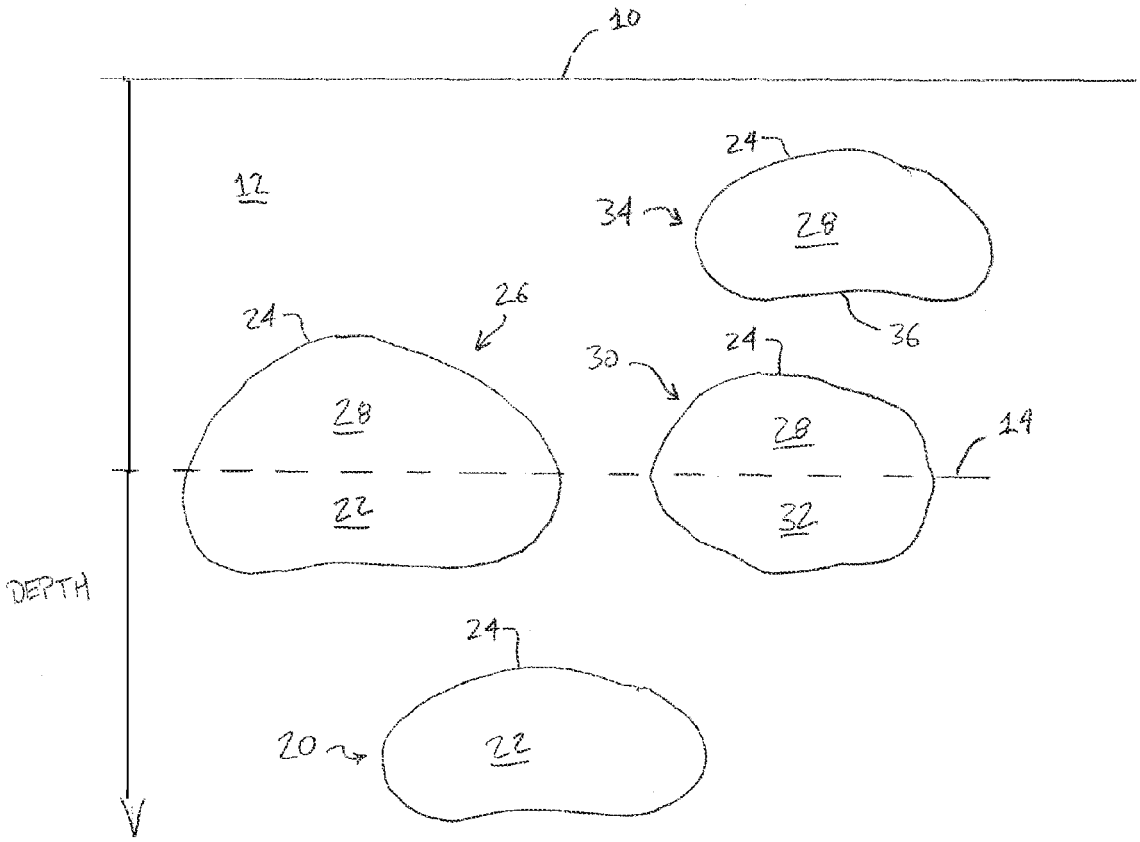
FIG. 1 is an illustration of examples of reservoir types.

FIG. 1 illustrates schematically a subsurface region that may alternately represent a region under the sea floor or under the land surface 10. For subsurface clathrates, there can be defined a clathrate stability zone 12, where the temperature and pressure conditions are favorable to the formation of a particular clathrate. This zone is defined by a base 14, which, though illustrated as a straight line at a particular depth, should be more broadly understood as a range of depths that will vary depending on specific conditions across the region. In general, below the base 14, temperatures are too high and/or pressures are too low for the formation and stability of a particular clathrate, as the host molecules lose their crystalline structure and thereby lease the guest molecule.

Within the subsurface region, there are four examples of reservoir types illustrated. A free gas reservoir 20, including gas 22 is shown in a region below the base 14. Though not shown, such a gas reservoir will be restricted from vertical movement by the presence of an impermeable (or, more accurately, low permeability) layer such as a shale layer or a salt formation forming a top seal 24. Free gas of this type can be produced according to known methods as will be appreciated by those of skill in the art.

Figure 2:
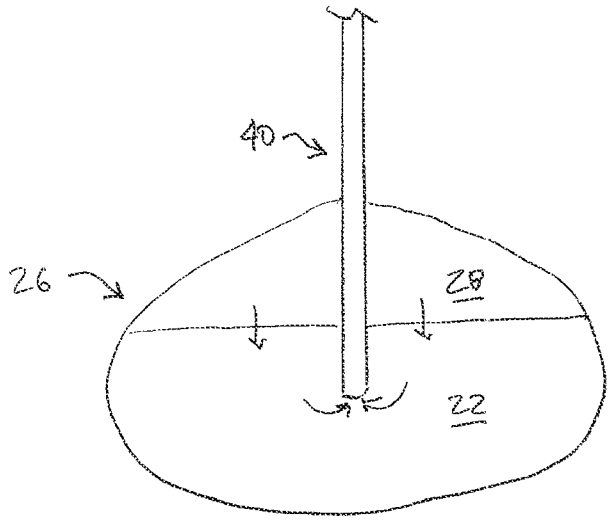
FIG. 2 is a schematic illustration of a method of production in a Class I reservoir.

A Class I reservoir 26 is shown in a region overlapping the base 14. In this type of reservoir, the hydrocarbon reservoir lies partially within the stability zone 12 and partially below the base 14. Below the base 14, the reservoir comprises free gas 22 and above it comprises clathrate 28. As illustrated in FIG. 2, the free gas can generally be produced in a conventional manner by drilling 40 into the free gas region. As gas is removed, the resulting reduction in pressure at the base of the clathrate 28 allows changes in the lattice structure to free at least a portion of the gas trapped in the clathrate 28 to recharge the free gas reservoir for continued conventional production. Likewise, heat (e.g., a heated fluid) may be added to the clathrate from external sources or from the heat of the deeper, hotter free gas and/or chemical clathrate inhibitors can be injected to increase the dissociation rate of the clathrate.

Figure 3:
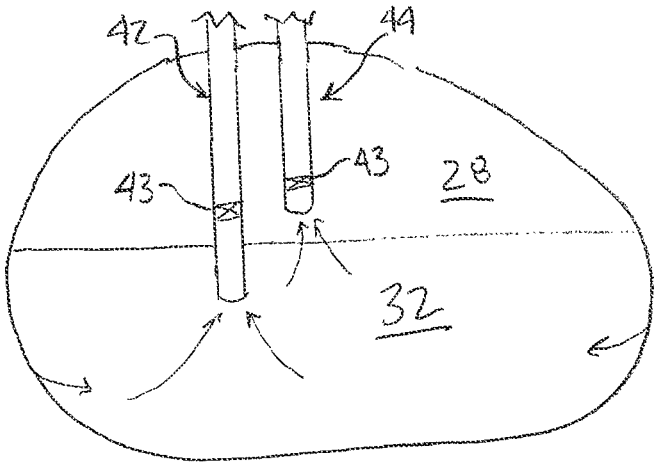
FIG. 3 is a schematic illustration of methods for attempted production in a Class II reservoir.

In a similar region overlapping the base, a Class II reservoir 30 is shown in FIG. 1. In the Class II reservoir 30, the clathrate 28 is underlain not by a free gas reservoir but rather by an aquifer 32 that includes water that is generally mobile. As illustrated in FIG. 3, production attempts could proceed by drilling 42 into the aquifer or 44 into the clathrate. In either case, attempts to reduce pressure by pumping water out of the reservoir using pump 43 will generally be met by further water entering the production zone from the surrounding regions. Similarly, heat and/or inhibitors added in an attempt to cause dissociation can be absorbed and dissipated by the water. Because the water in the reservoir is mobile, it can remove significant heat and/or inhibitors from the clathrate by way of convection, limiting the effectiveness of heating or inhibiting the clathrate.

Figure 4:
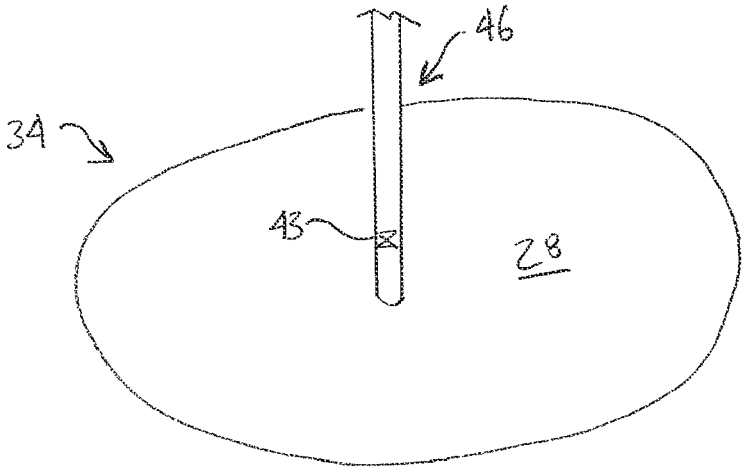
FIG. 4 is a schematic illustration of a method of production in a Class III reservoir.
Figure 5:
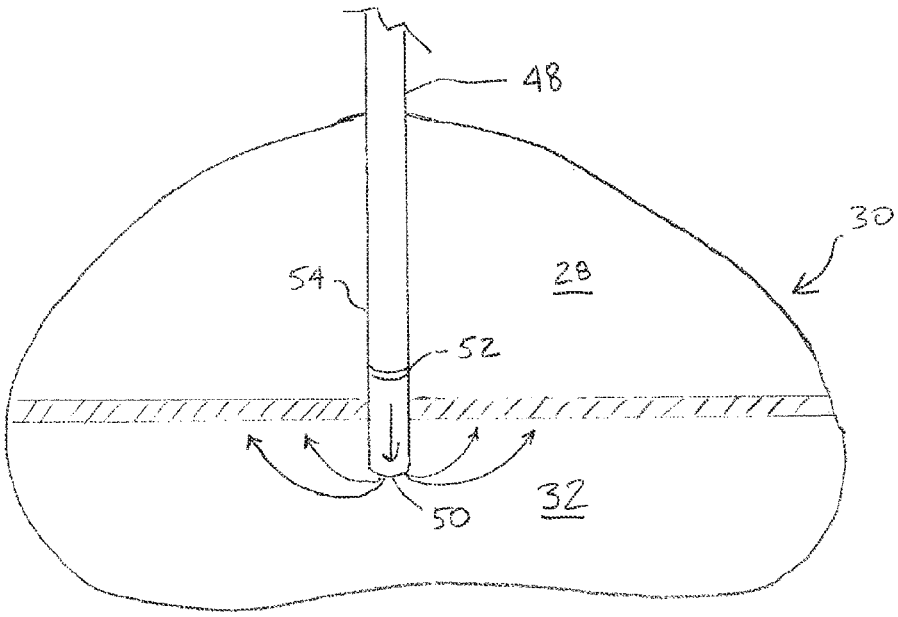
FIG. 5 is a schematic illustration of a method of improving a Class II reservoir in accordance with an embodiment of the invention.

In a region above the base 14, a Class III reservoir 34 is shown. In this type, the entire reservoir consists of clathrate 28, without free gas or water. In addition to the low permeability top seal 24, there is a low permeability bottom seal 36. Because the system is substantially closed, depressurization and/or heating and/or injection of clathrate-inhibiting materials show more promise for production than they do in Class II reservoirs. As shown in FIG. 4, the reservoir may be exploited by drilling 46 directly into the clathrate, causing a drop in pressure using, for example, a pump 43 and subsequently initiating and sustaining dissociation of the clathrate and producing the resulting free gas. One such method of production of clathrates that is suited to production in a Class III reservoir is described in U.S. Pat. No. 7,537,058, herein incorporated by reference in its entirety.

In this regard, the inventor has determined that it may be valuable to modify a Class II reservoir such that it behaves similarly to a Class III reservoir.

FIG. 4 illustrates a method of upgrading a Class II reservoir. The aquifer zone 32 is drilled 48. Preferably the drill end 50 is positioned just inside the aquifer 32, relatively near the boundary between the clathrate and the aquifer. A material is injected into the aquifer zone that is selected such that it can flow through the rock pores to form a barrier in the region of the boundary.

As will be appreciated, suitable materials should be compatible with drill string fluid flow pathways. They should have viscosities selected such that they may flow well through the rock pores. The materials should have good ability to spread from the injection point to isolate a significant portion of the clathrate. Furthermore, to the extent that they include entrained solid particles (as will be discussed further, below), such particles should also be selected to be transportable through the aquifer. The materials should also be selected such that, once in place, they substantially impede flow of water from the aquifer 32 into the clathrate 28.

Once the barrier is established, the injection portion of the drill string may be isolated from the upper portion by use of packers 52 prior to initiating production in the clathrate zone. In this approach, perforations may be introduced into an upper portion 54 of the drill string. Alternately, additional wells may be drilled for production purposes.

Materials suited to formation of barriers in accordance with embodiments of the invention include cement, cement slurries and epoxies of the types typically employed in drilling and production operations. Additionally, it may be useful to include adjunct materials that reduce the density of the barrier material, thereby improving its ability to float on top of the aquifer fluid. For example, foamed or hollow spheres may be included in a cement mixture to increase the buoyancy thereof. Furthermore, when using a curable material, it may be useful to include a retarding adjunct that increases the cure time. As will be appreciated, increased cure time allows additional time for transport of the curable material prior to cure, thereby increasing the size of the sealed region.

In another approach, the barrier material may include clathrate forming materials that have greater stability than the native clathrates. For example, ethane, butane, $CO_2$, He, and $O_2$ all may form clathrates in water that may be stable at higher temperatures and/or lower pressures than for instance methane clathrates, a desirable hydrocarbon gas to be produced in the well. Those molecules or mixtures of such guest molecules can allow for design freedoms in meeting the temperature, pressure, clathrate inhibitor and molecular substitutions expected during evolution of the production zone over its useful lifetime.

Figure 6:
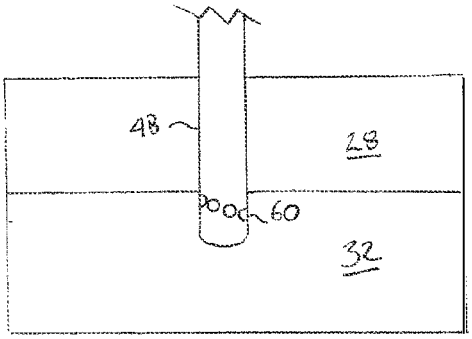
FIG. 6 is a schematic illustration of an embodiment of a device for producing shown in a Class II reservoir in accordance with an embodiment of the invention.

A device for injecting the barrier material is illustrated in FIG. 6. As shown, the drill string 48 includes a number of openings 60 around its circumference. Though a single row of openings is illustrated in the Figure, it will be appreciated that a number of rows of openings may be used, and that the openings may vary in size and position. The drill string is positionable such that the openings are located at a depth below the boundary between the clathrate reservoir and the aquifer for injection of the barrier material as described above.

Figure 7:
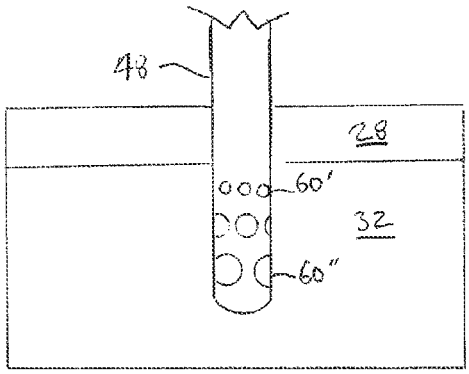
FIG. 7 is a schematic illustration of another embodiment of a device for producing shown in a Class II reservoir in accordance with an embodiment of the invention.

In a particular example illustrated in FIG. 7, openings 60' located closer to the barrier region are configured to produce a lower flow rate than that produced by openings 60" located in more distal portions of the drill string.

Figure 8:
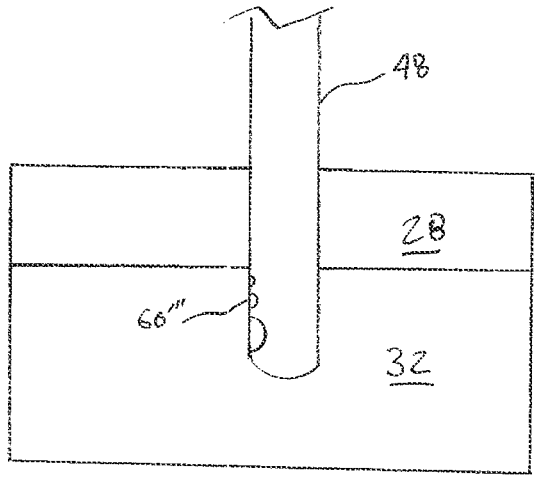
FIG. 8 is a schematic illustration of another embodiment of a device for producing shown in a Class II reservoir in accordance with an embodiment of the invention.

In another particular example illustrated in FIG. 8, the openings 60' may be positioned on only a particular side of the drill string to allow for directional injection of the barrier material. Such a device may be suited to operation in an environment where the clathrate formation has a particular orientation that should be accounted for. Rotation of the end of the drill string, for example, may allow for control of a direction of outflow of the barrier material.

Figure 9:
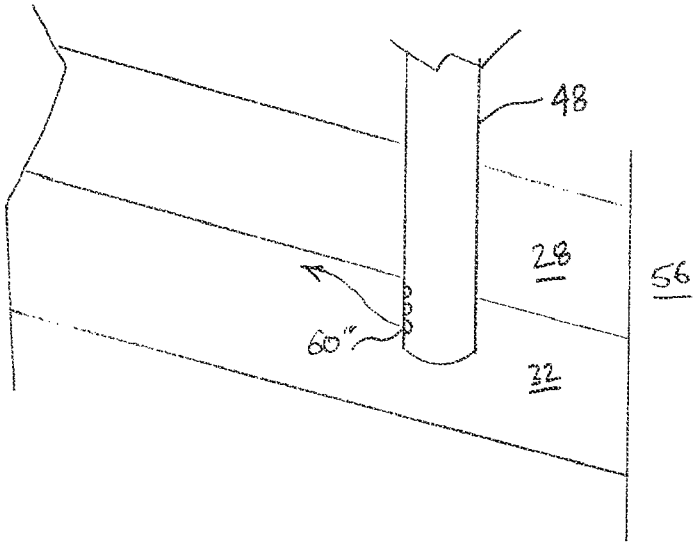
FIG. 9 is a schematic illustration of an application of the device of FIG. 8.

By way of example, the device of FIG. 8 may be well suited to a formation of a type schematically illustrated in FIG. 9. In the formation illustrated in FIG. 9, the clathrate and aquifer dip, and a trapping structure 56 forms a lower end of the dipping reservoir. As shown, directional openings allow for injection of material that flows upward along the dip direction to seal the clathrate formation from the aquifer.

Figure 10:
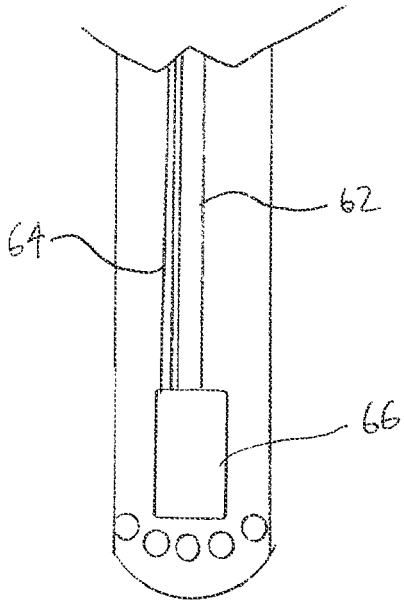
FIG. 10 is a schematic illustration of another embodiment of a device for producing shown in a Class II reservoir in accordance with an embodiment of the invention.

In another particular example illustrated in FIG. 10, the drill string may include separable fluid paths 62, 64 such that a two-part epoxy may be separately transported to a distal portion of the drill string. Near the injection openings, there is a mixing region 66 that allows the two parts of the epoxy to blend, initiating the curing process just prior to injection into the aquifer formation. As will be appreciated, though two parts are described and illustrated, there may be more than two fluids injected into the mixing region. For example, a retardant may be separately transported and mixed along with the epoxy components in the mixing region.

As will be appreciated, the method as described herein may be performed using a computing system having machine executable instructions stored on a tangible medium. The instructions are executable to perform each portion of the method, either autonomously, or with the assistance of input from an operator. In an embodiment, the system includes structures for allowing input and output of data, and a display that is configured and arranged to display the intermediate and/or final products of the process steps. A method in accordance with an embodiment may include an automated selection of a location for exploitation and/or exploratory drilling for hydrocarbon resources.

Those skilled in the art will appreciate that the disclosed embodiments described herein are by way of example only, and that numerous variations will exist. The invention is limited only by the claims, which encompass the embodiments described herein as well as variants apparent to those skilled in the art. In addition, it should be appreciated that structural features or method steps shown or described in any one embodiment herein can be used in other embodiments as well.

The invention claimed is:

1. A method of improving producibility of a subsurface clathrate formation underlain by a mobile aquifer, comprising:

identifying a subsurface clathrate formation underlain by a mobile aquifer;

drilling a borehole to a depth providing access to the mobile aquifer; and injecting a material into the mobile aquifer, wherein the material is selected and an amount injected is selected such that the material passes through pore spaces and forms a barrier underlying the clathrate formation and substantially impeding fluid flow from the mobile aquifer into contact with the clathrate formation.

2. A method as in claim 1, further comprising:

after the injecting to form a barrier, inducing dissociation in at least a portion of the clathrates to produce a fluidic material; and producing the fluidic material comprising methane via the borehole or additional wells drilled into the clathrate formation.

3. A method as in claim 2, wherein the inducing comprises adding an inhibitor to the portion of the clathrates.

4. A method as in claim 2, wherein the inducing comprises applying heat to the portion of the clathrates.

5. A method as in claim 2, wherein the inducing comprises controlling a pressure in a region of the portion of the clathrates.

6. A method as in claim 1, wherein the material comprises a curable material and wherein, prior to production from the subsurface clathrate formation, the curable material is allowed to cure.

7. A method as in claim 6, wherein the curable material further comprises a retardant selected to slow a curing time of the curable material such that a spread of the material away from the material's injection site is increased prior to setting relative to a spread of the curable material in an absence of the retardant.

8. A method as in claim 6, wherein the curable material has an average density less than that of a fluid present in the mobile aquifer.

9. A method as in claim 6, wherein the curable material comprises a material selected from the group consisting of cement, cement slurry, epoxy, foamed cement, and cement comprising hollow spheres or combinations thereof.

10. A method as in claim 1, wherein the material comprises a hydrate forming material or combination of materials selected to combine with water in the mobile aquifer to form a hydrate layer below the clathrate formation, the formed hydrate layer having greater stability than a stability of the clathrate formation.

11. A method as in claim 1, wherein the clathrates comprise methane hydrates.

* * * * *